US010207831B2

(12) United States Patent
Naaber

(10) Patent No.: US 10,207,831 B2
(45) Date of Patent: Feb. 19, 2019

(54) DEVICE FOR CLOSING CONTAINERS

(75) Inventor: Matthias Naaber, Bretzenheim (DE)

(73) Assignee: KHS GmbH, Dortmund (DE)

( * ) Notice: Subject to any disclaimer, the term of this patent is extended or adjusted under 35 U.S.C. 154(b) by 720 days.

(21) Appl. No.: 14/233,516

(22) PCT Filed: Jun. 28, 2012

(86) PCT No.: PCT/EP2012/002709
§ 371 (c)(1),
(2), (4) Date: Jan. 17, 2014

(87) PCT Pub. No.: WO2013/013752
PCT Pub. Date: Jan. 31, 2013

(65) Prior Publication Data

US 2014/0165501 A1 Jun. 19, 2014

(30) Foreign Application Priority Data

Jul. 26, 2011 (DE) ..... 10 2011 108 429

(51) Int. Cl.
*B65B 7/00* (2006.01)
*B67B 3/20* (2006.01)

(52) U.S. Cl.
CPC ..... *B65B 7/00* (2013.01); *B67B 3/2033* (2013.01); *B67B 3/2053* (2013.01)

(58) Field of Classification Search
CPC ..... B65B 7/00
See application file for complete search history.

(56) References Cited

U.S. PATENT DOCUMENTS 1,734,529 A * 11/1929 Pennock ..... B67B 3/2033 53/317
1,748,960 A * 3/1930 Risser ..... B67B 3/2033 53/304
1,966,889 A * 7/1934 Fagan ..... B67C 7/00 141/149
3,660,963 A * 5/1972 Sullivan ..... B67B 3/12 53/201
5,473,855 A * 12/1995 Hidding ..... B65B 7/2835 53/314
2004/0187441 A1* 9/2004 Cirio ..... B67B 3/18 53/432
2004/0226261 A1* 11/2004 Graffin ..... B67B 3/2073 53/75
2005/0150193 A1* 7/2005 Bernhard ..... B67B 3/2033 53/490
2006/0123738 A1* 6/2006 Bernhard ..... B67B 3/206 53/300

(Continued)

FOREIGN PATENT DOCUMENTS

DE 44 15 227 11/1995
DE 199 46 374 3/2001

(Continued)

*Primary Examiner* — Hemant M Desai
*Assistant Examiner* — Tanzim Imam
(74) *Attorney, Agent, or Firm* — Occhiuti & Rohlicek LLP

(57) ABSTRACT

An apparatus for closing a container includes closer stations. Each closer station has a closer tool, a coupling element, and a driver. The coupling element, with height-control, is positively guided to rotate about a machine axis thereof. Additionally, the coupling element, by way of the driver, drives the closer tool in a required vertical motion.

20 Claims, 3 Drawing Sheets

(56) References Cited

U.S. PATENT DOCUMENTS

| | | | | |
|---|---|---|---|---|
| 2009/0223169 | A1* | 9/2009 | Zanini | B67B 3/2033 53/317 |
| 2010/0126116 | A1* | 5/2010 | Buchhauser | B67B 3/00 53/287 |
| 2010/0205904 | A1* | 8/2010 | Zanini | B67B 3/22 53/287 |
| 2010/0212259 | A1* | 8/2010 | Knieling | B67B 3/2033 53/285 |

FOREIGN PATENT DOCUMENTS

| | | | | |
|---|---|---|---|---|
| DE | 20 2006 003975 | | 7/2007 | |
| DE | 202006003975 | U1 * | 7/2007 | B67B 3/2033 |
| DE | 10 2007 057857 | | 11/2007 | |
| EP | 0 889 002 | | 1/1999 | |
| EP | 2 221 272 | | 8/2010 | |
| WO | 2009/016502 | | 2/2009 | |
| WO | 2010/118806 | | 10/2010 | |

* cited by examiner

DEVICE FOR CLOSING CONTAINERS

RELATED APPLICATIONS

This application is a national stage entry under 35 U.S.C. 371 of PCT/EP2012/002709, filed on Jun. 28, 2012, which claims the benefit of the Jul. 26, 2011 priority date of German application DE 10 2011 108 429.4, the content of which is herein incorporated by reference.

FIELD OF INVENTION

The invention relates to a device for closing containers, comprising a plurality of closer stations that are formed on a periphery of a rotor that can be driven to rotate about the vertical machine axis, and that each have a closer tool.

BACKGROUND

Devices for closing containers are known from DE 10 2007 057 857 A1 as closing machines for closing bottles with screw closures that are attached by screwing onto a bottle-side male thread in the region of the bottle mouth in different versions.

In known devices, a closure is applied with a closer tool or closer cone in which the bottle closure is held until it is applied to a bottle and that can be driven to rotate by a drive for the application of the closure onto the bottle or for screwing on.

During the closing process, because of the geometrical circumstances on a closing machine, it is often necessary to vary a distance between the bottom of the closer cone and the top of the bottle mouth, e.g. in order to compensate for variation in distance arising from the operation of screwing the closure onto the threads. With certain embodiments of known closers, this distance is varied by having the bottom of the closer cone remain at one height level ile the container to be closed executes all necessary motions in the vertical plane.

As DE 10 2007 057 857 A1 further discloses, known closing machines, i.e. screw closers and also crown stopper machines, have, on a rotor that can be driven to rotate about a vertical machine axis, a plurality of closer stations, each with a closer tool and with a bottle carrier or container carrier that, as the rotor rotates, can be moved up and down under control of a lifting cam, this being for feeding a bottle to the closer tool before closing and for separating the closed bottle from the closer tool.

Closing machines in which containers are closed with the aid of crown stoppers are also known. Variations in the distance, for which compensation may be necessary, also occur on such closing machines. This can be achieved as described above. There is, of course, no screwing motion of the closing die in this case.

Hence closing machines are known whose container carriers are controlled by way of mechanical lifting cams. DE 10 2007 057 857 A1 makes the practical proposal of replacing such lifting cam drives by a controlled and regulated drive.

The proposal set forth by DE 10 2007 057 857 A1 has proven to be of value in practice to the extent that the required vertical motion was configurable in a user-programmable manner. A linear motor could, for example, be used for the controlled or regulated linear motion.

DE 10 2009 017 019 A1 is also concerned with a closing machine, although in this instance a torque is transmitted magnetically from the drive shaft to the closer tool. This too has proven to be of value in practice.

SUMMARY

The object of the invention is to improve a device of the type referred to at the outset while using mechanical lifting cams.

According to the present invention, it is advantageous to provide a closer station that has a mechanical coupling element that, by lifting-cam-control, is positively guided to rotate about the machine axis and that, by positive guidance, also drives the closer tool by way of a driver in a necessary vertical motion.

For the transmission of the vertical motion from the coupling element to the closer tool, there is provided a transmission means or a driver that has at least one connection arm that is disposed on a guide sleeve. The guide sleeve encloses a section of the closer tool or its shaft. Alternatively, the guide sleeve is attached to such a section. This guide sleeve can also have two or more guide rods or the like, and serves to transmit torque to the closer head during the simultaneous relative change in distance between the drive motor and the closer head.

If the closer tool is configured as a rotary closer tool, then it is preferable that it be able to be rotated. It is therefore expedient that the guide sleeve be connected to the corresponding section of the closer tool by way of bearings such that both the required vertical motion and also a required rotation of the closer tool are possible.

The preferred embodiment makes provision for the closer tool to execute the required vertical motion, with the container being held against the container carrier unchangeably when seen in the vertical direction. It is therefore expedient in the interest of the invention that the closer tool have a shaft with a fixed-position shaft portion and a movable shaft portion so as to form a shaft that is variable in length, for example, a telescoping shaft. The motorized rotary drive of the closer tool is therefore advantageously carried unchangeably in the vertical direction.

In the case of the preferred embodiment, all components rotate together with the rotor about the vertical machine axis. To this extent the coupling element is expediently connected to the rotor.

The container carrier can be configured as a support plate or also be disposed on a linear guide. It is therefore mounted immovably in regard to its elevation. The container carrier can preferably be disposed on a free end at the foot of the linear guide.

For guiding the connection arms of the driver, the linear guide can be provided parallel to the vertical machine axis. The linear guide can display a dual function to this extent. On the one hand, it can guide the connection arms of the driver in the vertical direction. On the other hand, the linear guide can represent the container carrier, which is unable to move vertically.

With the invention it is possible to move only the closer tool, in particular its cone, on the movable shaft portion in the required vertical tracking. Complicated container tracking can thus be dispensed with. It is also expedient that the rotary drive of the closer tool be fixed in the vertical direction so that there will only be a small number of moving components and so that the maintenance effort for these few moving components will also be considerably reduced. Suitable materials can of course be used, and preference can be given to the use of plastics because they tend to be particularly simple and easy-to-clean option, especially in the food sector.

BRIEF DESCRIPTION OF THE DRAWINGS

Further advantageous embodiments of the invention are disclosed in the dependent claims and the following description of the figures, in which:

Because identical parts are indicated by the same reference characters in the different figures, they are normally described only once and only entered once in the figures.

DETAILED DESCRIPTION

Figure 1:
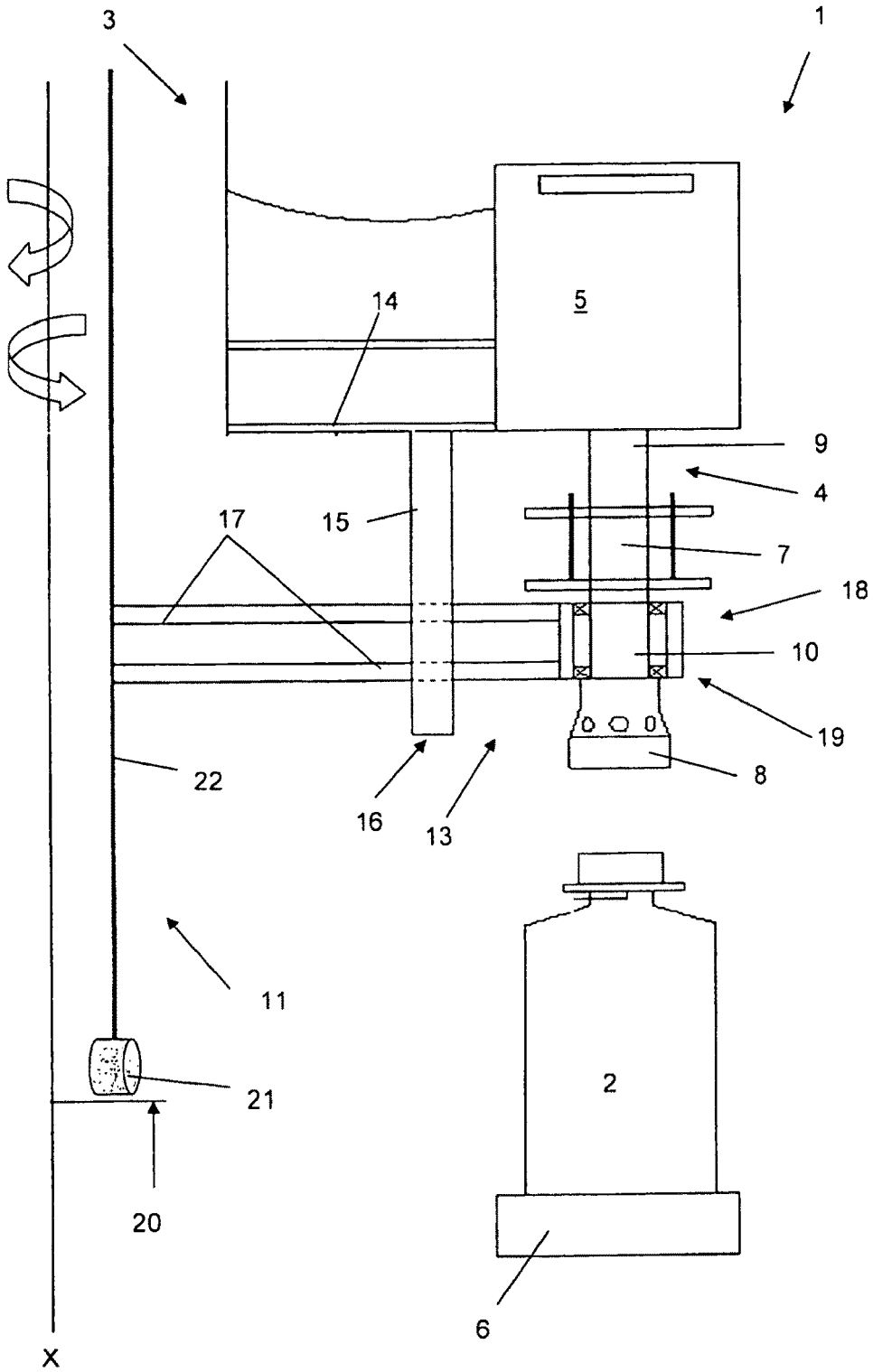
FIG. 1 shows a schematic diagram of an individual closer station in side view.

FIG. 1 shows an individual closer station 1 of a device for closing containers 2. The device may also be referred to as a "closing machine." The device includes a plurality of closer stations 1 formed on a periphery of a rotor 3 that can be driven to rotate about a vertical machine axis X. Closer stations 1 each exhibit or include a closer tool 4.

In the case of the depicted embodiment, the closer tool 4 can be set in rotary motion by way of a rotary drive 5. To this extent, FIG. 1 shows, by way of example, a device for closing containers 2 with screw caps.

A container 2 stands on a container carrier 6 that, when seen in vertical direction, i.e. along vertical machine axis X, is immobile and in the configuration of a support plate. Other container carriers can also be used of course, such as those in which the container is transported while suspended. What is practicable about the invention however is that the container carrier, whatever its design, is unchangeable in its elevation despite its rotational motion about the machine axis X.

The closer tool 4 exhibits a shaft 7 at the end of which is an acting section 8 or cone 8. The cone 8 can hold the screw cap. The shaft 7 is variable in length, and can be executed, for example, in the manner of a telescope having a fixed-position shaft portion 9 and a shaft portion 10 movable relative thereto. Fixed-position upper shaft portion 9 is connected to rotary drive 5. Movable lower shaft portion 10 is connected to cone 8.

Respective closer station 1 exhibits a mechanically acting coupling element 11 that, by lifting-cam-control, is positively guided to rotate about machine axis X and that, by positive guidance, also drives closer tool 4 by way of a driver 13 in a necessary vertical motion. To this extent, the invention compensates for the distance of container 2 from closer tool 4 solely by a vertical motion of the lower part of closer tool 4 or of lower shaft portion 10 with its connected elements.

Rotary drive 5 is connected to rotor 3 and rotates together with the latter. A linear guide 15 is arranged on a connecting apparatus 14 of rotary drive 5 for rotor 3. Linear guide 15 extends in a direction oriented away from connecting apparatus 14 running parallel to vertical machine axis X with its free end 16 pointing downward.

Driver 13 is provided on movable shaft portion 10 of shaft 7. Driver 13 exhibits connection arms 17 and a guide sleeve 18. Two connection arms 17 are shown by way of example, which is not to be taken as limiting. A single connection arm 17 or more than two would also be conceivable. Connection arms 17 are attached to coupling element 11, or to the latter's guide rod 22 on the one hand and to guide sleeve 18 on the other. Connection arms 17 are shown in FIG. 1 by broken lines, but they are of course continuous. Guide sleeve 18 encloses movable shaft portion 10 of shaft 7, for example, in its entirety. Guide sleeve 18 can be closed in its entirety or be partially open. Guide sleeve 18 also exhibits a bearing device 19 that, apart from the common rotation about machine axis X, only effects a translational motion and enables the rotation of cone 8 that is connected to, and driven by, guide sleeve 18. Vertically movable shaft portion 10 of shaft 7 can be moved along or parallel to vertical machine axis X by these means. Movable shaft portion 10 of shaft 7 can also rotate however, specifically in the direction of rotation that is determined by rotary drive 5.

Figure 2:
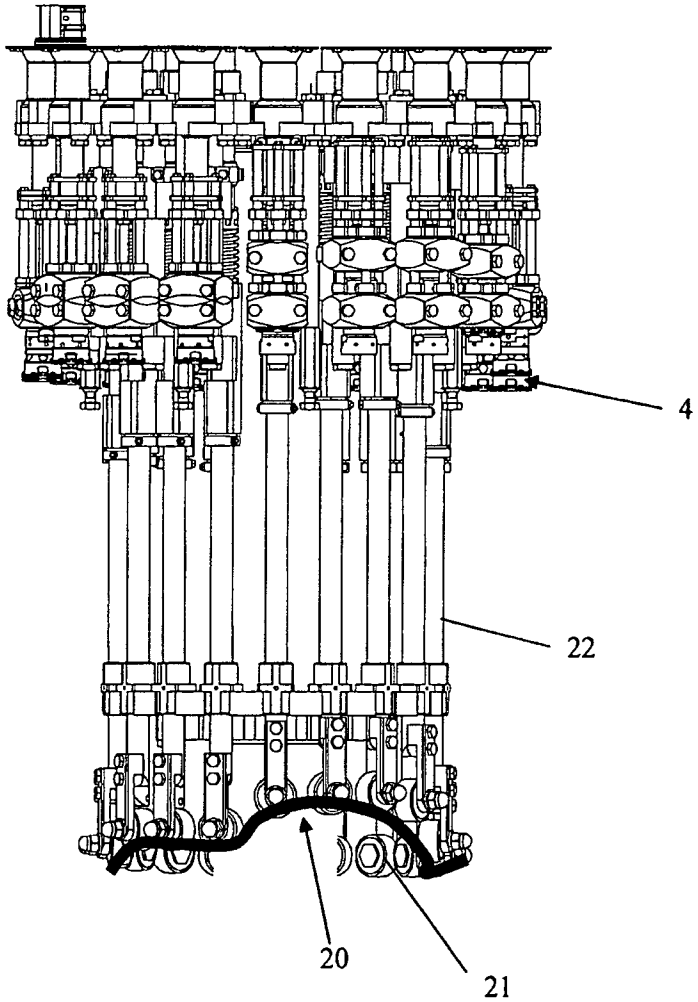
FIG. 2 shows, by way of example, a plurality of coupling elements along an exemplary lifting cam in perspective partial view.

When coupling element 11 now rotates about machine axis X along lifting cam 20 (FIG. 2), cone 8 is also necessarily driven through forced entrainment by driver 13, or by the latter's connection arms 17 and by guide sleeve 18.

Coupling element 11 exhibits a roll 21 at its lower end and a guide rod 22 that is carried in a guide that is not shown. The coupling element runs along lifting cam 20 about machine axis X.

A closer station with closing die can of course also be analogously realized as a crown stopper machine. There would obviously be no rotary drive in such a case.

Figures 3, 4:
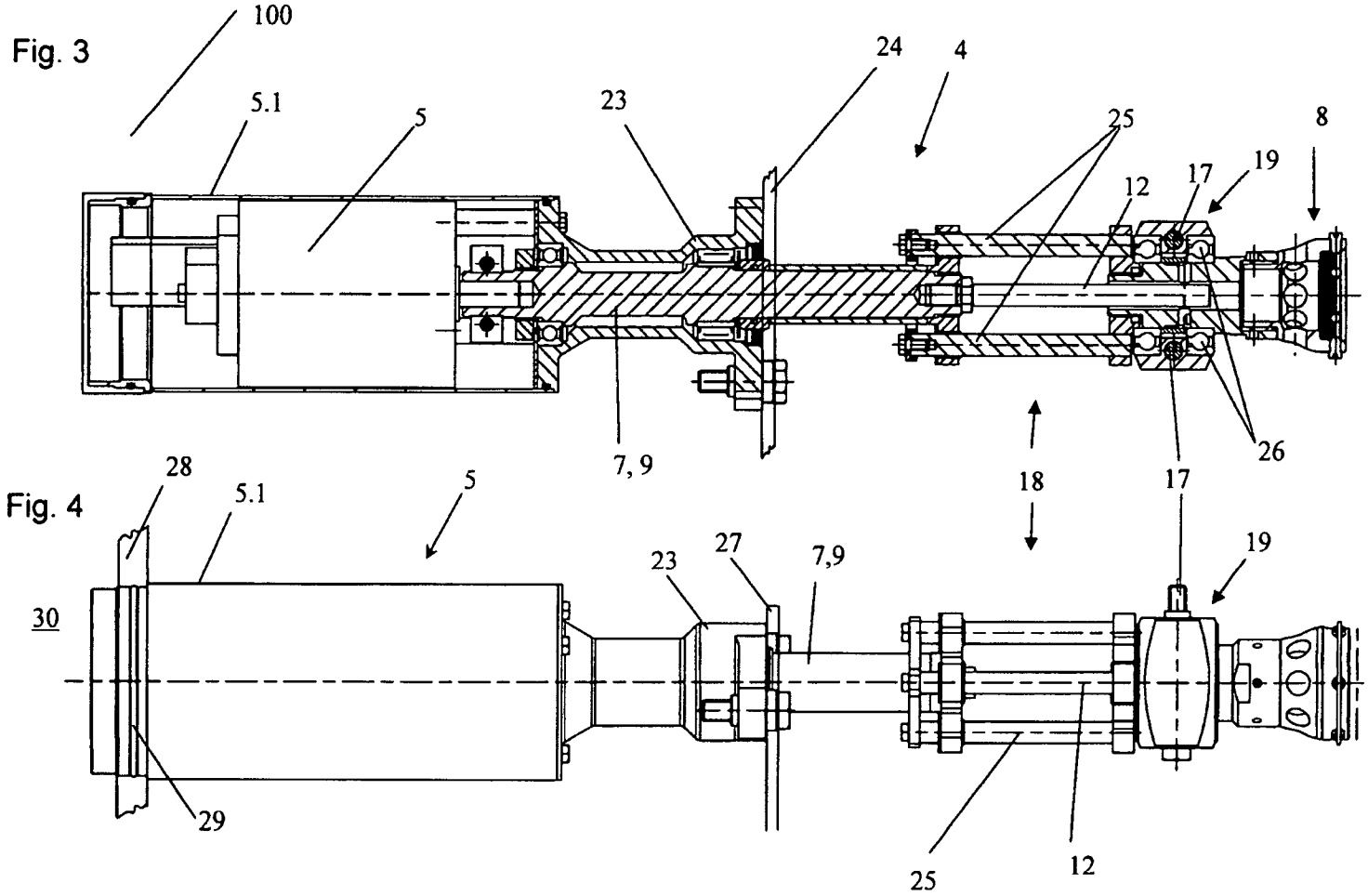
FIG. 3 is an enlarged view of a closer tool with a drive as a section drawing.
FIG. 4 is a side view of the closer tool with the drive from FIG. 4.

FIG. 3 shows closer tool 4 with associated rotary drive 5. In the embodiment according to FIG. 3, rotary drive 5 is attached by its foot housing 23 to a cover 24, which can be referred to as an interior-space cover 24. Through foot housing 23 extends shaft 7, or its fixed-positioner shaft portion 9, which is rotatable. In the embodiment according to FIG. 3, shaft portion 9 is adjoined by guide sleeve 18, which, for example, exhibits four linear guides or linear bars 25 of which only two are visible owing to the chosen mode of representation. The head of guide sleeve 18 is connected to the foot of shaft portion 9 or of shaft 7. The foot end of guide sleeve 18 exhibits a suitable bearing 26. At the head end, linear bars 25 can be displaced axially relative to shaft 7 and towards rotary drive 5. Guide sleeve 18 is thus not just axially but also rotationally movable and drivable relative to shaft 7 and also serves, with simultaneous relative distance variation between rotary drive 5 and closer head 8, to transmit torque to the closer head or cone 8. To this extent, guide sleeve 18 with bearing 26 and bearing device 19 respectively has also assumed the function of movable shaft portion 10 as described in relation to FIG. 1. Connection arm(s) 17 can act on the outer periphery of bearing device 19. Closer tool 4 also exhibits an ejector 12 that is not described any further.

In the case of the view and version according to FIG. 4, only a bearing element 27 to which rotary drive 5 is attached has been provided in the previous position of the interior-space cover. The interior space in this case extends as far as cover plate/transition plate 28, into which outer sleeves 5.1 of rotary drive 5 are inserted and sealed by way of an O-ring seal 29. Cover plate/transition plate 28 constitutes the base-plate of an electrical space 30 into which projects sleeve 5.1 of rotary drive 5, which (outer sleeve) is open at the top. Otherwise, the embodiment of FIG. 4 is the same as the embodiment according to FIG. 3.

Even though the above embodiments and figures have only shown and described a closer in rotary design, the mode of action and fundamental principle can be transposed analogously to linear closers or linear filling and closing machines. The closer tools are arranged in a row adjacent to one another in this case.

In the case of linear filling and closing machines that operate in steps or sequentially, such as those comparable with those described in DE 10 2005 032 322 A1, the closer tools of the closer stations are disposed as a group transversely and above the main transport path of the containers and are vertically movable in common.

LIST OF REFERENCE CHARACTERS

1 Closer station
2 Container
3 Rotor
4 Closer tool
5 Rotary drive
5.1 Sleeve (outer) of 5
6 Container carrier
7 Shaft
8 Cone on 4
9 Fixed-position shaft portion of 7
10 Movable shaft portion of 7
11 Coupling element
12 Ejector
13 Driver
14 Connecting apparatus
15 Linear guide
16 Free end of 15
17 Connection arms
18 Guide sleeve
19 Bearing device
20 Lifting cam
21 Roller
22 Guide rod
23 Foot housing
24 Cover
25 Linear bars
26 Bearing
27 Bearing element
28 Cover plate/transition plate
29 O-ring seal
30 Electrical space

The invention claimed is:

1. An apparatus for closing a container, said apparatus comprising a plurality of closer stations that are arranged around a periphery of a rotor that rotates about a machine axis, each of said closer stations comprising a rotary drive for generating a torque, a closer tool comprising a shaft, wherein said shaft comprises a vertically-fixed upper-shaft portion and a vertically-movable lower-shaft portion, wherein said vertically-fixed upper-shaft portion contacts said rotary drive, thus forming a connection, wherein, as a result of said connection, which is a connection between said rotary drive and said vertically-fixed upper-shaft portion, said rotary drive causes said closer tool to rotate with said rotary drive, wherein, as a result of said connection between said rotary drive and said vertically-fixed upper-shaft portion, said rotary drive causes said vertically-movable lower-shaft portion to rotate with said rotary drive, a driver for causing said closer tool to engage in guided vertical motion via said vertically-fixed upper-shaft portion, said driver comprising a connection arm and a guide sleeve coupled to said connection arm, said guide sleeve comprising a bearing at a foot end of said guide sleeve, wherein said driver further comprises a plurality of linear bars extending along said guide sleeve, each of said linear bars comprising a head end connected to a foot portion of said upper-shaft portion and being configured to be displaced in an axial direction relative to said upper-shaft portion towards or away from said rotary drive, said linear bars being configured to be driven to rotate and to thereby transmit said torque to said closer tool, and a coupling element that provides positively guided height-control for raising and lowering said driver, said coupling element being configured to drive said closer tool in said guided vertical motion by way of said driver, thereby causing a change in a spacing between said closer tool and said container, said change in a spacing occurring concurrently with transmission of said torque to said closer tool.

2. The apparatus of claim 1, wherein said driver raises and lowers said closer tool without raising and lowering said rotary drive and wherein said rotary drive is connected to said closer tool.

3. The apparatus of claim 1, wherein said rotary drive is connected to said closer tool, and wherein said guided vertical motion is decoupled from said rotary drive.

4. The apparatus of claim 3, wherein said shaft comprises a variable-length shaft extending from said rotary drive, said variable-length shaft decoupling said rotary drive from said guided vertical motion.

5. The apparatus of claim 1, wherein said guided vertical motion is relative to said rotary drive.

6. The apparatus of claim 1, wherein said vertically-fixed upper-shaft portion is surrounded by said vertically-movable lower-shaft portion, and wherein said movable lower-shaft portion is formed by said plurality of linear bars.

7. The apparatus of claim 1, wherein said guide sleeve comprises a section of said closer tool.

8. The apparatus of claim 1, wherein said guide sleeve is secured to said closer tool.

9. The apparatus of claim 1, wherein said rotary drive comprises a foot housing, wherein said foot housing attaches said rotary drive to an interior-space cover, and wherein said shaft extends through said foot housing.

10. The apparatus of claim 1, further comprising a cover plate, an electrical space, and a bearing element, wherein said bearing element is attached to said rotary drive, wherein said cover plate defines a baseplate of said electrical space, wherein a sleeve of said rotary drive projects into said electrical space.

11. The apparatus of claim 1, wherein said connection arm extends radially outward from said coupling element to said guide sleeve, and wherein said guide sleeve is attached to said closer tool.

12. The apparatus of claim 11, wherein said guide sleeve is directly attached to said closer tool.

13. The apparatus of claim 1, wherein each of said linear bars extends along said guide sleeve, wherein said guided vertical motion extends along a first vertical axis, and wherein, for each of said linear bars, a vertical axis of said linear bar extends along a second vertical axis that is radially offset from said first vertical axis.

14. The apparatus of claim 1, wherein each of said closer stations further comprises a container carrier, wherein said container rests on said container carrier, and wherein said container carrier is vertically immovable.

15. The apparatus of claim 1, wherein said shaft comprises a telescopic shaft comprising said vertically-fixed upper-shaft portion and said vertically-movable lower-shaft portion, wherein said vertically-movable lower-shaft portion is movable relative to said vertically-fixed upper-shaft portion, wherein said vertically-movable lower-shaft portion comprises said linear bars, wherein said linear bars define said guide sleeve, and wherein said vertically-fixed upper-shaft portion passes through said guide sleeve.

16. The apparatus of claim 1, wherein said shaft comprises a variable-length shaft comprising said vertically-fixed upper-shaft portion, wherein said linear bars define said guide sleeve, and wherein said vertically-fixed upper-shaft portion passes through said guide sleeve such that, when said shaft is in a reduced-length position, said vertically-fixed upper-shaft portion is surrounded by said linear bars.

17. The apparatus of claim 1, said apparatus further comprising a linear guide and a connecting apparatus, wherein said linear guide has a first end and a second end, wherein said first end connects to said connecting apparatus, wherein said second end is a free end, wherein said linear guide extends along a vertical axis that is between said machine axis and an axis along which said guided vertical motion takes place, wherein said connecting apparatus couples said rotary drive to said linear guide, and wherein said rotary drive is vertically immovable.

18. The apparatus of claim 17, wherein said connection arm passes through said linear guide, wherein said connection arm extends along a direction that is perpendicular to said machine axis, and wherein said connection arm extends from said coupling element in a direction radially outward from said machine axis and toward said closer tool.

19. The apparatus of claim 17, further comprising a container carrier mounted on said linear guide so as to be vertically immovable.

20. The apparatus of claim 1, wherein said connection arm extends along a direction that is outward from said machine axis toward said closer tool, wherein said connection arm engages said bearing, wherein said bearing is between a cone of said closer tool and distal ends of said linear bars, wherein said distal ends are those ends that are furthest from said rotary drive, and wherein each of said rotary drives is vertically immovable.

* * * * *